US010788037B2

(12) United States Patent
Rosson et al.

(10) Patent No.: US 10,788,037 B2
(45) Date of Patent: Sep. 29, 2020

(54) SCROLL COMPRESSOR

(71) Applicant: Danfoss Commercial Compressors, S.A., Trevoux (FR)

(72) Inventors: Yves Rosson, Villars les Dombes (FR); Patrice Bonnefoi, Saint Didier au Mont d'or (FR); Ingrid Claudin, Villars les Dombes (FR)

(73) Assignee: Danfoss Commercial Compressors S.A., Trevoux (FR)

( * ) Notice: Subject to any disclaimer, the term of this patent is extended or adjusted under 35 U.S.C. 154(b) by 383 days.

(21) Appl. No.: 15/027,294

(22) PCT Filed: Sep. 16, 2014

(86) PCT No.: PCT/IB2014/064550
§ 371 (c)(1),
(2) Date: Apr. 5, 2016

(87) PCT Pub. No.: WO2015/052605
PCT Pub. Date: Apr. 16, 2015

(65) Prior Publication Data

US 2016/0238006 A1 Aug. 18, 2016

(30) Foreign Application Priority Data

Oct. 8, 2013 (FR) ..... 13 59729

(51) Int. Cl.
*F04C 18/02* (2006.01)
*F04C 29/00* (2006.01)
*F04C 29/04* (2006.01)

(52) U.S. Cl.
CPC ..... *F04C 18/0223* (2013.01); *F04C 29/005* (2013.01); *F04C 29/0085* (2013.01); *F04C 29/045* (2013.01)

(58) Field of Classification Search
CPC ..... F04C 18/0223; F04C 29/005; F04C 29/0085; F04C 29/045; F04C 23/008
(Continued)

(56) References Cited

U.S. PATENT DOCUMENTS 5,152,682 A * 10/1992 Morozumi ..... F04C 23/008 418/151
5,775,893 A * 7/1998 Takao ..... F01C 17/066 418/151

(Continued)

FOREIGN PATENT DOCUMENTS

CN 1955481 A 5/2007
CN 102257276 A 11/2011

(Continued)

OTHER PUBLICATIONS

English Translation of JP H08-165993 obtained on Nov. 1, 2018 (Year: 2018).*

(Continued)

*Primary Examiner* — Connor J Tremarche
(74) *Attorney, Agent, or Firm* — McCormick, Paulding & Huber PLLC

(57) ABSTRACT

This scroll compressor (2) includes a first and second fixed scrolls (4, 5) comprising first and second fixed spiral wraps (9, 12), an orbiting scroll arrangement (7) comprising first (Continued)

and second orbiting spiral wraps (14, 15), the first fixed spiral wrap (9) and the first orbiting spiral wrap (14) forming a plurality of first compression chambers (16) and the second fixed spiral wrap (5) and the second orbiting spiral wrap (15) forming a plurality of second compression chambers (17). The scroll compressor further includes a drive shaft (23) adapted for driving the orbiting scroll arrangement (7) in an orbital movement, and a driving motor (24) arranged for driving in rotation the drive shaft (23) about a rotation axis, the driving motor (24) being located nearby the first fixed scroll (4). The first fixed scroll (4) includes at least one first discharge passage (21) arranged to conduct the refrigerant compressed in the first compression chambers (16) towards the driving motor (24).

23 Claims, 5 Drawing Sheets

(58) Field of Classification Search
USPC ..... 417/410.5
See application file for complete search history.

(56) References Cited

U.S. PATENT DOCUMENTS

| | | | | |
|---|---|---|---|---|
| 2006/0062682 | A1* | 3/2006 | Cho | F01C 21/10 418/55.5 |
| 2006/0216180 | A1 | 9/2006 | Yanagisawa et al. | |
| 2011/0300013 | A1* | 12/2011 | Hwang | F04C 18/0223 418/55.3 |

FOREIGN PATENT DOCUMENTS

| | | | | |
|---|---|---|---|---|
| EP | 0 529 660 | A1 | | 3/1993 |
| EP | 0 777 053 | A1 | | 11/1996 |
| JP | 08-165993 | A | | 6/1996 |
| JP | H08-165993 | A | * | 6/1996 |
| JP | H08-170592 | A | | 7/1996 |
| JP | 2003-343459 | A | | 12/2003 |

OTHER PUBLICATIONS

International Search Report for PCT Serial No. PCT/IB2014/064550 dated Nov. 25, 2014.

* cited by examiner

SCROLL COMPRESSOR

CROSS-REFERENCE TO RELATED APPLICATIONS

This application is entitled to the benefit of and incorporates by reference subject matter disclosed in the International Patent Application No. PCT/IB2014/064550 filed on Sep. 16, 2014 and French Patent Application No. 13/59729 filed on Oct. 8, 2013.

TECHNICAL FIELD

The present invention relates to a scroll compressor, and in particular to a scroll refrigeration compressor.

BACKGROUND

U.S. Pat. No. 5,775,893 discloses a scroll compressor including:

a closed container, a scroll compression unit including:

a first fixed scroll and a second fixed scroll defining an inner volume, the first fixed scroll comprising a first fixed spiral wrap, the second fixed scroll comprising a second fixed spiral wrap, an orbiting scroll arrangement disposed in the inner volume, the orbiting scroll arrangement including a first orbiting spiral wrap and a second orbiting spiral wrap, the first fixed spiral wrap and the first orbiting spiral wrap forming a plurality of first compression chambers, the second fixed spiral wrap and the second orbiting spiral wrap forming a plurality of second compression chambers, a refrigerant suction pipe for supplying the inner volume with refrigerant to be compressed, a refrigerant discharge pipe arranged for discharging the compressed refrigerant outside the scroll compressor, a drive shaft including a driving portion adapted for driving the orbiting scroll arrangement in an orbital movement, and a driving motor arranged for driving in rotation the drive shaft about a rotation axis, the driving motor being located nearby the first fixed scroll and including a rotor coupled to the drive shaft and a stator.

According to such a scroll compressor, the central compression chambers of the first and second compression chambers are fluidly connected with each other such that the refrigerant compressed in the first and second compression chambers is discharged in a common upper discharge space fluidly connected the refrigerant discharge pipe, the compressed refrigerant being then guided outside of the closed container through the refrigerant discharge pipe.

Such a configuration of the scroll compressor prevents a satisfactory cooling of the driving motor with the compressed refrigerant, and thus reduces the efficiency of the scroll compressor.

SUMMARY

It is an object of the present invention to provide an improved scroll compressor which can overcome the drawbacks encountered in conventional scroll compressors.

Another object of the present invention is to provide a scroll compressor which is reliable and has an improved efficiency compared to the conventional scroll compressors.

According to the invention such a scroll compressor includes:

a closed container, a scroll compression unit including:

a first fixed scroll and a second fixed scroll defining an inner volume, the first fixed scroll comprising a first fixed base plate and a first fixed spiral wrap, the second fixed scroll comprising a second fixed base plate and a second fixed spiral wrap, an orbiting scroll arrangement disposed in the inner volume, the orbiting scroll arrangement including a first orbiting spiral wrap and a second orbiting spiral wrap, the first fixed spiral wrap and the first orbiting spiral wrap forming a plurality of first compression chambers, the second fixed spiral wrap and the second orbiting spiral wrap forming a plurality of second compression chambers, a drive shaft including a driving portion adapted for driving the orbiting scroll arrangement in an orbital movement, a driving motor arranged for driving in rotation the drive shaft about a rotation axis, the driving motor including a rotor coupled to the drive shaft and a stator, the first fixed base plate having a first face directed towards the driving motor and a second face opposite to the first face and directed towards the second fixed scroll, wherein the first fixed scroll includes at least one first discharge passage arranged to conduct, in use, the refrigerant compressed in the first compression chambers towards the driving motor, and particularly in direction of the driving motor, and wherein the orbiting scroll arrangement includes at least one communicating hole arranged to fluidly connect a central first compression chamber and a central second compression chamber.

The configuration of the at least one first discharge passage allows to force the refrigerant compressed in the first compression chambers to flow along a large part of the driving motor before being discharged outside the scroll compressor, which improve the cooling of the driving motor, and thus the efficiency of the scroll compressor.

According to an embodiment of the invention, the at least one first discharge passage emerges in the first face of the first fixed base plate.

According to an embodiment of the invention, the driving motor is arranged nearby the first fixed scroll.

According to an embodiment of the invention, the stator includes a first winding head directed towards the first fixed scroll and a second winding head opposite to the first winding head, the scroll compressor further including an intermediate casing surrounding the stator and in which the driving motor is at least partially mounted, the intermediate casing and the driving motor at least partially defining a proximal chamber containing the first winding head of the stator.

According to an embodiment of the invention, the at least one first discharge passage emerges nearby the driving motor, notably nearby the stator, and for example nearby the first winding head of the stator.

According to an embodiment of the invention, the at least one first discharge passage is oriented towards the driving motor, and for example towards the first winding head of the stator.

According to an embodiment of the invention, the at least one first discharge passage emerges in the proximal chamber. This arrangement of the at least one first discharge passage allows to force the refrigerant compressed in the first compression chambers to flow along the first winding head of the stator, the air gaps between the stator and the rotor and the possible refrigerant flow passages defined between the intermediate casing and the stator. Such provisions further improve the cooling of the driving motor, and thus the efficiency of the scroll compressor.

According to an embodiment of the invention, the at least one first discharge passage is fluidly connected to the central first compression chamber, and is arranged to conduct the refrigerant compressed in the central first compression chamber towards the driving motor.

According to an embodiment of the invention, the first fixed scroll and the drive shaft define a first annular chamber fluidly connected to the central first compression chamber, the at least one first discharge passage being fluidly connected to the first annular chamber, and advantageously emerging in the first annular chamber.

According to an embodiment of the invention, the intermediate casing and the driving motor define a distal chamber containing the second winding head of the stator, the intermediate casing being provided with at least one refrigerant discharge aperture emerging in the distal chamber. These provisions ensure a more efficient cooling of the second winding head and limit the oil circulating rate, i.e. the amount of oil going out of the scroll compressor.

According to an embodiment of the invention, the driving motor is entirely mounted in the intermediate casing. Preferably, the intermediate casing includes a side part surrounding the driving motor and a closing part arranged for closing an end portion of the side part.

According to an embodiment of the invention, the intermediate casing and the stator define at least one refrigerant passage arranged to fluidly connect the proximal chamber to the distal chamber.

According to an embodiment of the invention, the rotor and the stator define at least one refrigerant passage arranged to fluidly connect the proximal chamber to the distal chamber.

According to an embodiment of the invention, the at least one first discharge passage is inclined relative to the rotation axis of the drive shaft.

According to an embodiment of the invention, the first fixed scroll includes a plurality of first discharge passages. The first discharge passages may be for example angularly offset from each other in relation to the rotation axis of the drive shaft.

According to an embodiment of the invention, the intermediate casing and the closed container define an annular volume.

According to an embodiment of the invention, the at least one refrigerant discharge aperture is arranged to fluidly connect the annular volume and the distal chamber.

According to an embodiment of the invention, the drive shaft extends across the orbiting scroll arrangement and further includes a first guided portion and second guided portion located on either side of the driving portion, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

In other words, the orbiting scroll arrangement comprises a first side facing toward the first guided portion of the drive shaft and the at least one first guide bearing, and a second side opposite to the first side and facing toward the second guided portion of the drive shaft and the at least one second guide bearing.

Such a location of the first and second guide bearings reduces the drive shaft deflection. The reduction of the drive shaft deflection at the guide bearings locations improves the guide bearings reliability. Moreover, the reduction of the drive shaft deflection at the rotor location avoids on one hand the rotor-stator contacts in the driving motor and thus improves the driving motor reliability, and reduces on the other hand the mechanical loads applied on the guide bearings and thus further improves the guide bearings reliability. Furthermore the reduction of the drive shaft deflection at the rotor location allows reducing the motor air gap and so improves the driving motor performances.

All these improvements allow to operate the scroll compressor safely in the whole operating speed range and notably at high rotational speeds (that is at a rotation speed much higher than 9000 rpm), and improve compressor reliability and performance.

According to an embodiment of the invention, the drive shaft further includes a rotor support portion on which is mounted the rotor, the guide elements being located on a same side of the drive shaft in relation to the rotor support portion.

According to an embodiment of the invention, the rotor support portion forms a first end portion of the drive shaft. The rotor support portion may for example be set back from the second winding head of the stator.

According to an embodiment of the invention, the rotor includes a first rotor end portion directed towards the first fixed scroll and a second rotor end portion opposite to the first rotor end portion, the rotor support portion being set back from the second rotor end portion.

According to an embodiment of the invention, the scroll compressor further includes a first counterweight and a second counterweight connected to the drive shaft, the first and second counterweights being located respectively on either side of the orbiting scroll arrangement. In other words, the first and second sides of the orbiting scroll arrangement face toward respectively the first and second counterweights. This arrangement of the first and second counterweights allows to balance the mass of the orbiting scroll arrangement with a limited tilting of the drive shaft. Such a limited tilting of the drive shaft, as the reduction of the deflection of the drive shaft, improves the guide bearings reliability and the driving motor reliability, and therefore the compressor reliability and performance.

According to an embodiment of the invention, the drive shaft and at least one of the first and second counterweights are formed as a one-piece element.

According to an embodiment of the invention, the scroll compressor further includes:

- a first Oldham coupling provided between the orbiting scroll arrangement and the first fixed scroll, and configured to prevent rotation of the orbiting scroll arrangement with respect to the first fixed scroll, the first Oldham coupling being slidable with respect to the first fixed scroll along a first displacement direction,
- a second Oldham coupling provided between the orbiting scroll arrangement and the second fixed scroll, and configured to prevent rotation of the orbiting scroll arrangement with respect to the second fixed scroll, the second Oldham coupling being slidable with respect to the second fixed scroll along a second displacement direction which is transverse with respect to the first displacement direction.

Due to the transverse movements of the first and second Oldham couplings, the centers of gravity of the first and second Oldham couplings can be assimilated to a rotating mass, which can be easily balanced by a rotating counterweight attached to the drive shaft. Therefore, compressor vibrations generated by the translation movements of the first and second Oldham couplings can be greatly reduced. Such a limitation of the compressor vibrations leads to an improvement of the compressor reliability and efficiency.

According to an embodiment of the invention, the second displacement direction is substantially orthogonal to the first displacement direction. For example, the first and second displacement directions of said first and second Oldham couplings may be orthogonal with respect to each other, or may be inclined by an angle comprised between 80 and 100°, and preferably between 85 and 95°.

According to an embodiment of the invention, the first and second displacement directions are substantially perpendicular to the rotation axis of the drive shaft.

According to an embodiment of the invention, each of the first and second Oldham couplings undergoes a reciprocating motion respectively along the first and second displacement directions.

According to an embodiment of the invention, the first and second Oldham couplings respectively include first and second annular bodies that are substantially parallel to each other.

According to an embodiment of the invention, the first Oldham coupling includes:

a first annular body, a first pair of first guiding grooves provided on the first annular body, the first guiding grooves of the first Oldham coupling slidably receiving a first pair of first engaging projections provided on the first fixed scroll, said first guiding grooves being offset and extending substantially parallel to the first displacement direction, and a second pair of second guiding grooves provided on the first annular body, the second guiding grooves of the first Oldham coupling slidably receiving a second pair of second engaging projections provided on the orbiting scroll arrangement, said second guiding grooves being offset and extending substantially perpendicularly to the first displacement direction.

According to an embodiment of the invention, the first annular body is disposed around the first fixed spiral wrap and the first orbiting spiral wrap.

According to another embodiment of the invention, the first pair of first engaging projections may be provided on the first annular body, and the first pair of first guiding grooves may be provided on the first fixed scroll.

According to another embodiment of the invention, the second pair of second engaging projections may be provided on the first annular body, and the second pair of second guiding grooves may be provided on the orbiting scroll arrangement.

According to an embodiment of the invention, the second Oldham coupling includes:

a second annular body, a first pair of first guiding grooves provided on the second annular body, the first guiding grooves of the second Oldham coupling slidably receiving a first pair of first engaging projections provided on the second fixed scroll, said first guiding grooves being offset and extending substantially parallel to the second displacement direction, and a second pair of second guiding grooves provided on the second annular body, the second guiding grooves of the second Oldham coupling slidably receiving a second pair of second engaging projections provided on the orbiting scroll arrangement, said second guiding grooves being offset and extending substantially perpendicularly to the second displacement direction.

According to another embodiment of the invention, the first pair of first engaging projections may be provided on the second annular body, and the first pair of first guiding grooves may be provided on the second fixed scroll.

According to another embodiment of the invention, the second pair of second engaging projections may be provided on the second annular body, and the second pair of second guiding grooves may be provided on the orbiting scroll arrangement.

According to an embodiment of the invention, the scroll compressor is a vertical scroll compressor and the drive shaft extends substantially vertically. The driving motor may be located above the scroll compression unit.

According to an embodiment of the invention, the scroll compressor further includes a refrigerant suction element for supplying the inner volume with refrigerant to be compressed.

According to an embodiment of the invention, the refrigerant suction element is sealingly connected to the inner volume. The refrigerant suction element may for example include an end portion emerging in the inner volume. Therefore, the refrigerant enters the inner volume without cooling down beforehand the driving motor and thus without being heated by the driving motor, which also improves the driving motor efficiency.

According to an embodiment of the invention, the scroll compression unit comprises a connecting portion delimited at least in part by at least one of the first and second fixed scrolls, the connecting portion emerging in the inner volume, the end portion of the refrigerant suction element being sealingly mounted into the connecting portion.

According to an embodiment of the invention, the scroll compressor further includes a refrigerant discharge element arranged for discharging the compressed refrigerant outside the scroll compressor.

According to an embodiment of the invention, the first and second orbiting spiral wraps are respectively provided on first and second faces of a common base plate, the second face being opposite to the first face.

According to an embodiment of the invention, the drive shaft comprises at least one lubrication channel connected to an oil sump of the scroll compressor and extending over at least a part of the length of the drive shaft.

According to an embodiment of the invention, the drive shaft further comprises at least a first lubrication hole and a second lubrication hole each fluidly connected to a respective lubrication channel, the first and second lubrication holes opening respectively into an outer wall of the first and second guided portions of the drive shaft.

According to an embodiment of the invention, the closed container defines a high pressure discharge volume containing the driving motor. Advantageously, refrigerant suction element is fluidly isolated from the high pressure discharge volume. The scroll compression unit may also be contained in the high pressure discharge volume.

The refrigerant discharge element may for example emerge in the high pressure discharge volume defined by the closed container.

According to an embodiment of the invention, the second fixed scroll includes at least one second discharge passage arranged to conduct, in use, at least a part of the refrigerant compressed in the second compression chambers outside the inner volume.

According to an embodiment of the invention, the at least one second discharge passage is fluidly connected to the high pressure discharge volume and is arranged to conduct, in use, the refrigerant compressed in the second compression chambers towards the high pressure discharge volume.

According to an embodiment of the invention, the second fixed base plate has a first face directed towards the first fixed scroll and a second face opposite to the first face, the at least one second discharge passage emerging in the second face of the second fixed base plate.

According to an embodiment of the invention, the at least one second discharge passage is inclined relative to the rotation axis of the drive shaft.

According to an embodiment of the invention, the at least one second discharge passage is fluidly connected to the central second compression chamber, and is arranged to conduct the refrigerant compressed in the central second compression chamber outside the inner volume.

According to an embodiment of the invention, the second fixed scroll and the drive shaft define a second annular chamber fluidly connected to the central second compression chamber, the at least one second discharge passage being fluidly connected to the second annular chamber, and advantageously emerging in the second annular chamber.

According to an embodiment of the invention, the second fixed scroll includes a plurality of second discharge passages. The second discharge passages may be for example angularly offset from each other in relation to the rotation axis of the drive shaft.

According to an embodiment of the invention, the scroll compressor is a variable-speed scroll compressor.

According to an embodiment of the invention, the first and second fixed scrolls are fixed in relation to the closed container.

According to an embodiment of the invention, the orbiting scroll arrangement is made in light material, such as aluminum alloy.

The communicating hole may for example emerge respectively in the central first and second compression chambers.

According to an embodiment of the invention, the scroll compressor is arranged such that at least a part of the refrigerant compressed in the central second compression chamber is conducted to the at least one first discharge passage via the communicating hole. These provisions improve the cooling of the driving motor.

These and other advantages will become apparent upon reading the following description in view of the drawing attached hereto representing, as non-limiting examples, embodiments of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
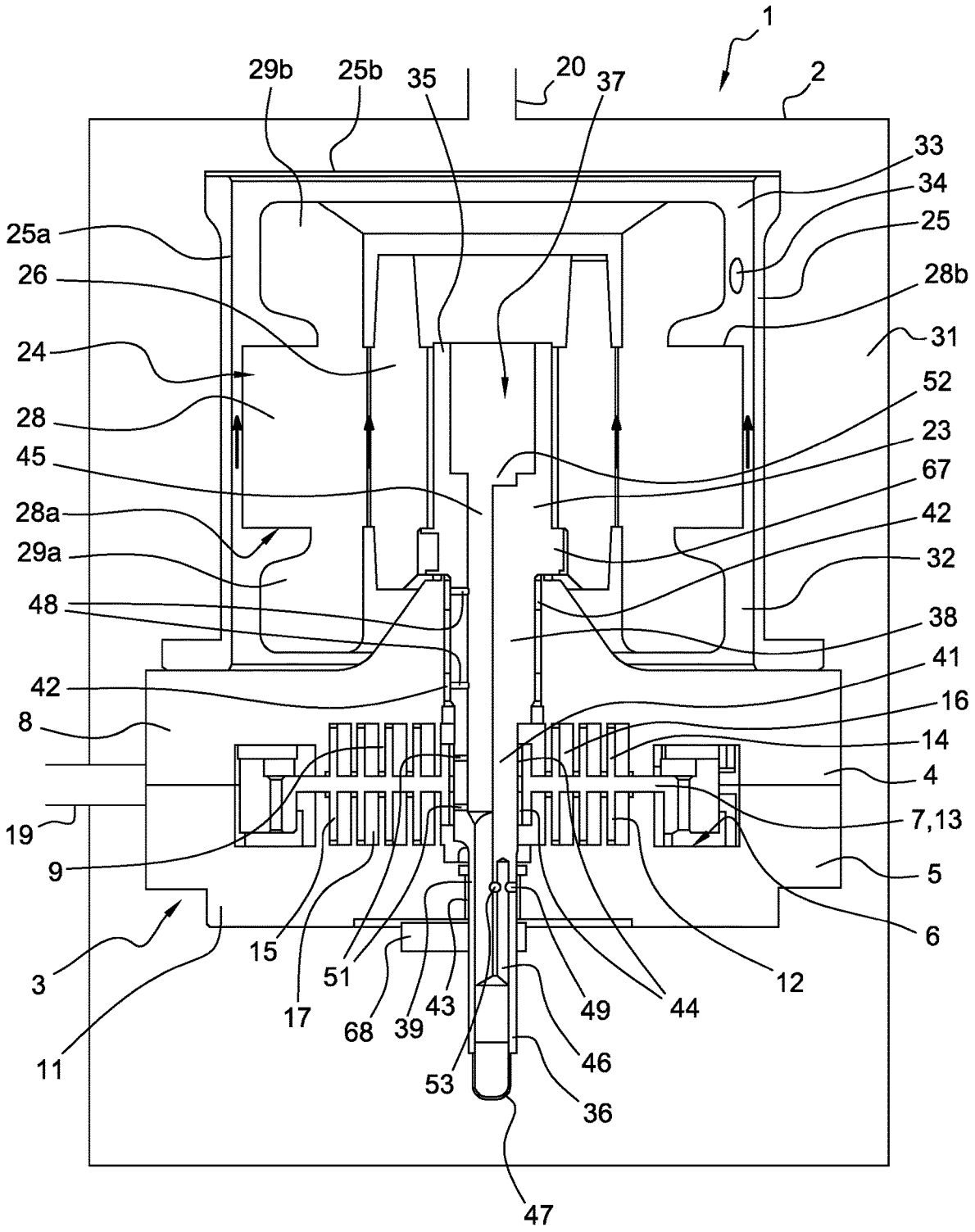
FIGS. 1 and 2 are longitudinal section views of a scroll compressor according to the invention.
Figure 2:
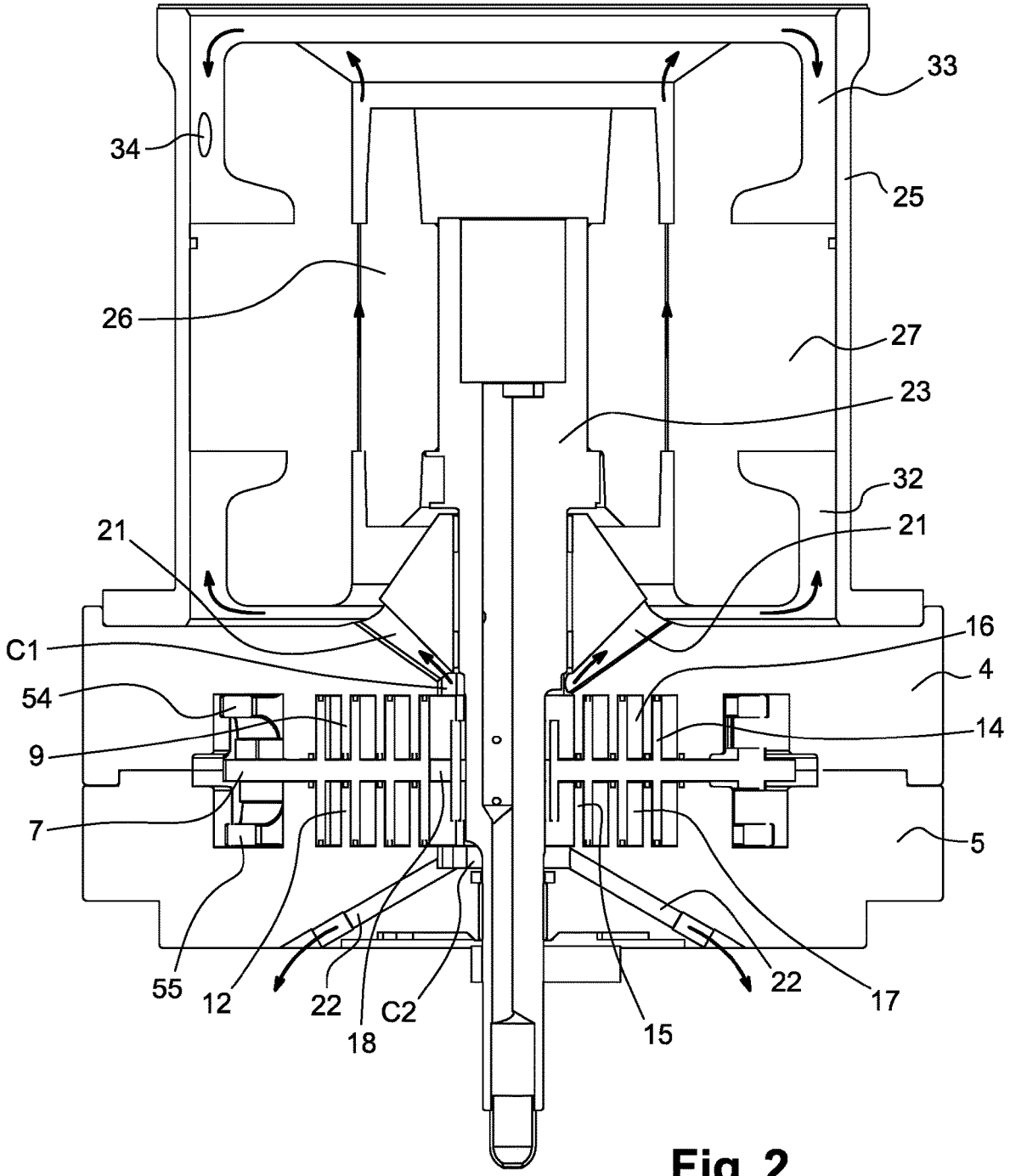
Figure 3:
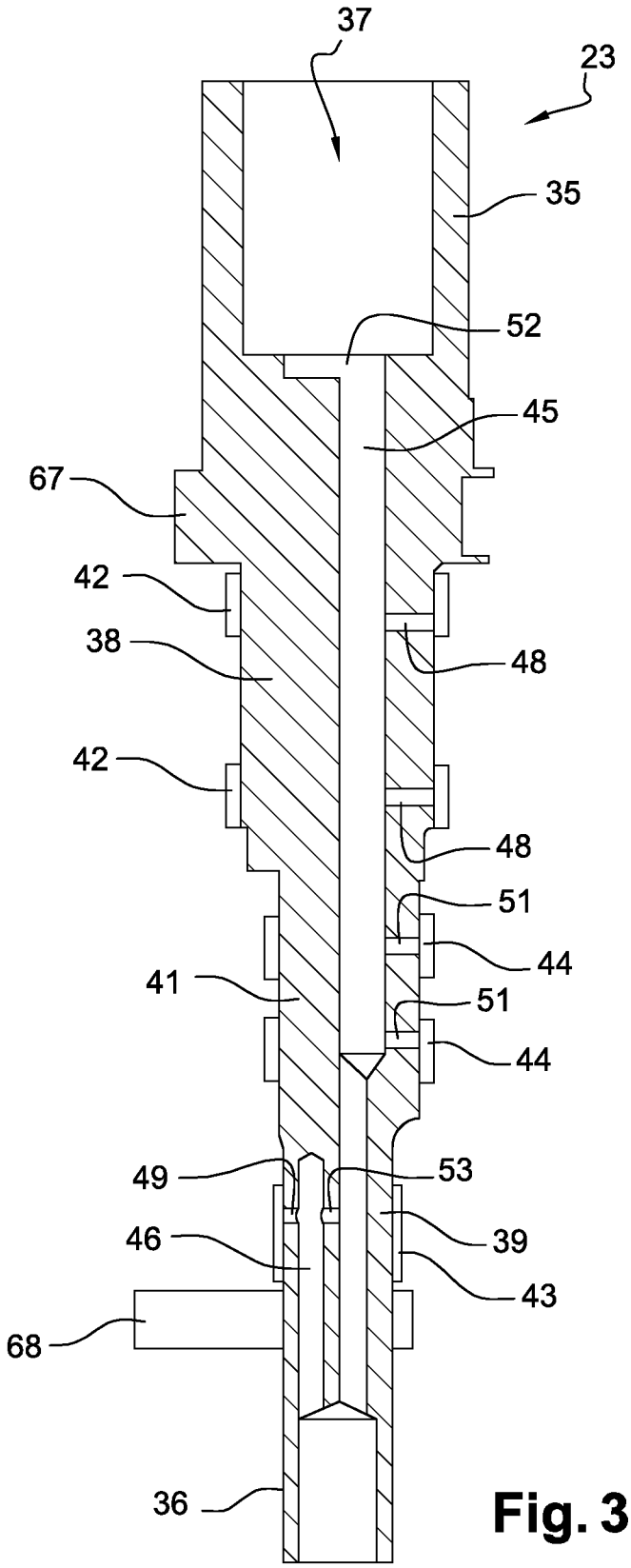
FIG. 3 is a longitudinal section view of the drive shaft of the scroll compressor of FIG. 1.
Figure 4:
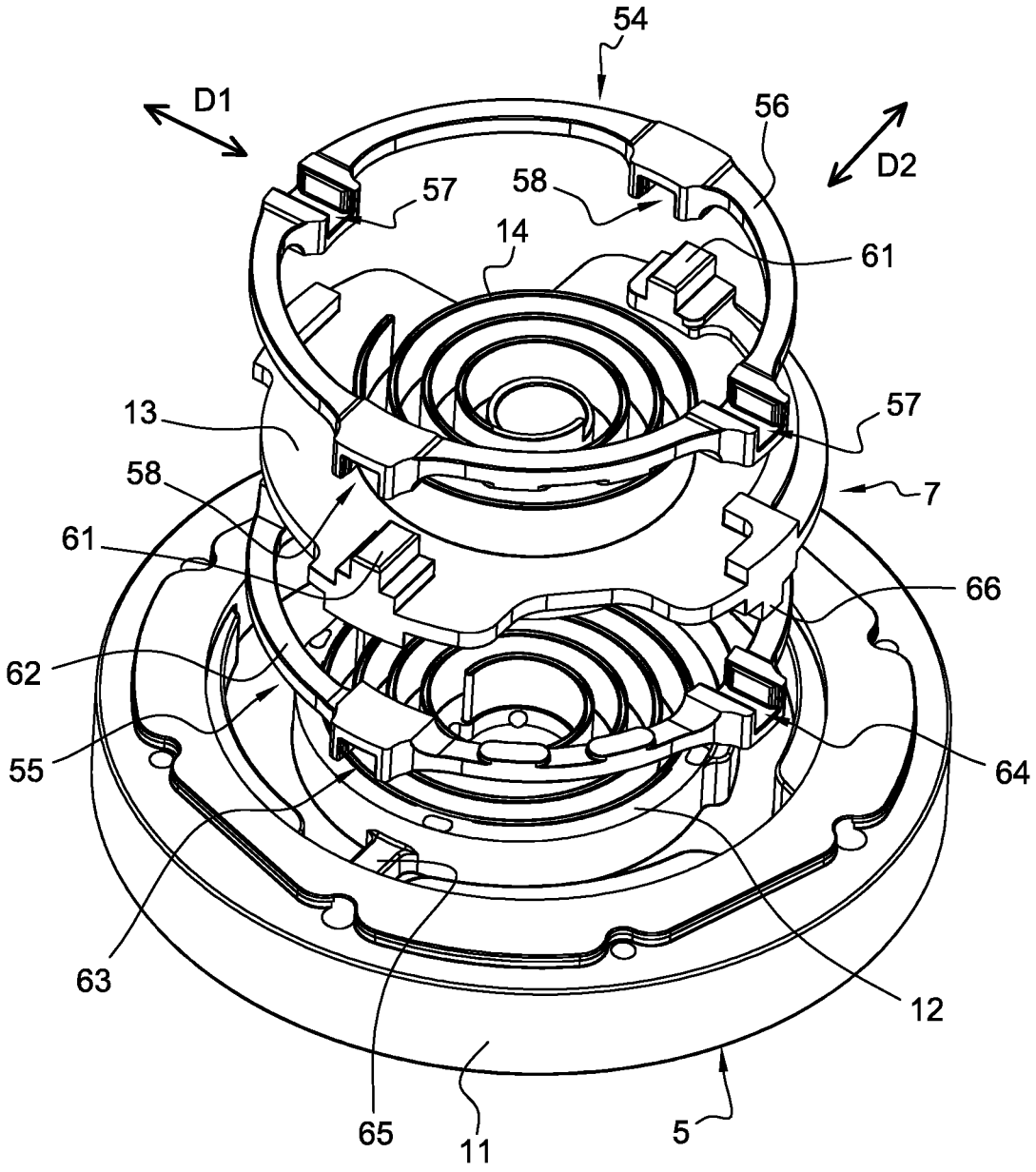
FIGS. 4 and 5 are exploded perspective views of two Oldham couplings and of an orbiting scroll arrangement of the scroll compressor of FIG. 1.
Figure 5:
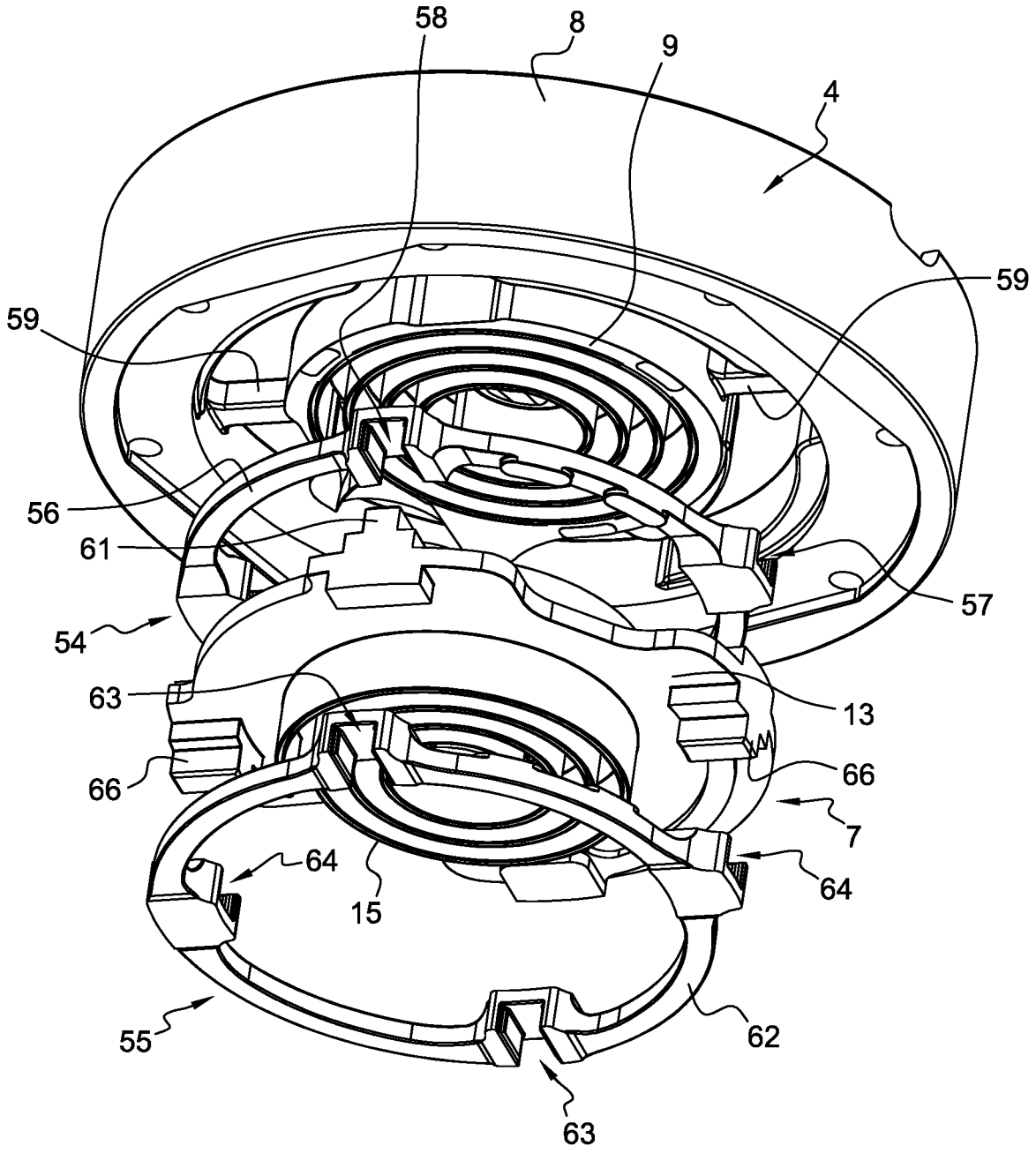

FIG. 1 shows a vertical scroll compressor 1 including a closed container 2 defining a high pressure discharge volume, and a scroll compression unit 3 disposed inside the closed container 2.

The scroll compression unit 3 includes first and second fixed scrolls 4, 5 defining an inner volume 6. In particular the first and second fixed scrolls 4, 5 are fixed in relation to the closed container 2. The first fixed scroll 4 may for example be secured to the second fixed scroll 5. The scroll compression unit 3 further includes an orbiting scroll arrangement 7 disposed in the inner volume 6.

The first fixed scroll 4 includes a base plate 8 and a spiral wrap 9 projecting from the base plate 8 towards the second fixed scroll 5, and the second fixed scroll 5 includes a base plate 11 and a spiral wrap 12 projecting from the base plate 11 towards the first fixed scroll 4.

The orbiting scroll arrangement 7 includes a base plate 13, a first spiral wrap 14 projecting from a first face of the base plate 13 towards the first fixed scroll 4, and a second spiral wrap 15 projecting from a second face of the base plate 13 towards the second fixed scroll 5, the second face being opposite to the first face such that the first and second spiral wraps 14, 15 project in opposite directions. The first and second fixed scrolls 4, 5 are respectively located above and below the orbiting scroll arrangement 7.

The first spiral wrap 14 of the orbiting scroll arrangement 7 meshes with the spiral wrap 9 of the first fixed scroll 4 to form a plurality of compression chambers 16 between them, and the second spiral wrap 15 of the orbiting scroll arrangement 7 meshes with the spiral wrap 12 of the second fixed scroll 5 to form a plurality of compression chambers 17 between them. Each of the compression chambers 16, 17 has a variable volume which decreases from the outside towards the inside, when the orbiting scroll arrangement 7 is driven to orbit relative to the first and second fixed scrolls 4, 5.

The orbiting scroll arrangement 7 includes at least one communicating hole 18 arranged to fluidly connect the central compression chamber 16 and the central compression chamber 17. The communicating hole 18 may for example emerge respectively in the central first and second compression chambers 16, 17.

The scroll compressor 1 also includes a refrigerant suction pipe 19 communicating with the inner chamber 6 to achieve the supply of refrigerant to the scroll compression unit 3, and a refrigerant discharge pipe 20 for discharging the compressed refrigerant outside the scroll compressor 1. The refrigerant suction pipe 19 may for example be sealingly connected to the inner volume 6. The refrigerant discharge pipe 20 may for example emerge in the high pressure discharge volume.

The first fixed scroll 4 includes a plurality of discharge passages 21 fluidly connected to the high pressure discharge volume and arranged to conduct the refrigerant compressed in the compression chambers 16 outside the inner volume 6.

The second fixed scroll 5 also includes a plurality of discharge passage 22 fluidly connected to the high pressure discharge volume and arranged to conduct the refrigerant compressed in the compression chambers 17 outside the inner volume 6.

Furthermore the scroll compressor 1 includes a stepped drive shaft 23 adapted for driving the orbiting scroll arrangement 7 in orbital movements, an electric driving motor 24 coupled to the drive shaft 23 and arranged for driving in rotation the drive shaft 23 about a rotation axis, and an intermediate casing 25 fixed on the first fixed scroll 4 and in which the driving motor 24 is entirely mounted.

Each discharge passage 21 is provided in the base plate 8 of the first fixed scroll 4, and includes a first end portion emerging in an annular chamber C1 defined by the first fixed scroll 4 and the drive shaft 23 and fluidly connected to the central compression chamber 16, and a second end portion emerging outside the inner volume 6. Each discharge passage 22 is provided in the base plate 11 of the second fixed scroll 5, and includes a first end portion emerging in an annular chamber C2 defined by the second fixed scroll 5 and the drive shaft 23 and fluidly connected to the central compression chamber 17, and a second end portion emerging outside the inner volume 6 towards an oil sump defined by the closed container 2.

The driving motor 24, which may be a variable-speed electric motor, is located above the first fixed scroll 4. The driving motor 24 has a rotor 26 fitted on the drive shaft 23, and a stator 27 disposed around the rotor 26. The stator 27 includes a stator stack or stator core 28, and stator windings wound on the stator core 28. The stator windings define a first winding head 29*a* which is formed by the portions of the stator windings extending towards outside from the end face 28*a* of the stator core 28 oriented towards the scroll compression unit 3, and a second winding head 29*b* which is formed by the portions of the stator windings extending towards outside from the end face 28*b* of the stator core 28 opposite to the scroll compression unit 3.

As shown in FIG. 1, the intermediate casing 25 and the closed container 2 define an annular outer volume 31 fluidly connected to the discharge pipe 20. Further the intermediate casing 25 and the driving motor 24 define a proximal chamber 32 containing the first winding head 29*a* of the stator 27, and a distal chamber 33 containing the second winding head 29*b* of the stator 27.

The intermediate casing 25 is provided with a plurality of refrigerant discharge apertures 34 emerging in the distal chamber 33 and arranged to fluidly connect the distal chamber 33 and the annular outer volume 31. According to the embodiment shown on the figures, the intermediate casing 25 includes a side part 25*a* surrounding the stator 27 and a closing part 25*b* closing an end portion of the side part 25*a* opposite to the first fixed scroll 4.

According to the embodiment shown on the figures, the second end portion of each discharge passages 21 emerges in the proximal chamber 32 nearby the driving motor 24, and particularly nearby the first winding head 29*a* of the stator 27. Advantageously, each of the discharge passages 21, 22 is inclined relative to the rotation axis of the drive shaft 23.

The drive shaft 23 extends vertically across the base plate 13 of the orbiting scroll arrangement 7. The drive shaft 23 comprises a first end portion 35 located above the first fixed scroll 4 and on which is fitted the rotor 26, and a second end portion 36 opposite to the first end portion 35 and located below the second fixed scroll 5. The first end portion 35 has an external diameter larger than the external diameter of the second end portion 36. The first end portion 35 includes a central recess 37 emerging in the end face of the drive shaft 23 opposite to the second end portion 36.

The drive shaft 23 further comprises a first guided portion 38 and a second guided portion 39 located between the first and second end portion 35, 36, and an eccentric driving portion 41 located between the first and second guided portions 38, 39 and being off-centered from the center axis of the drive shaft 23. The eccentric driving portion 41 is arranged to cooperate with the orbiting scroll arrangement 7 so as to cause the latter to be driven in an orbital movement relative to the first and second fixed scrolls 4, 5 when the driving motor 24 is operated.

The scroll compressor 1 further comprises guide elements for guiding in rotation the drive shaft 23 about its rotation axis. The guide elements comprise at least one first guide bearing 42 provided on the first fixed scroll 4 and arranged for guiding the first guided portion 38 of the drive shaft 23, and one second guide bearing 43 provided on the second fixed scroll 5 and arranged for guiding the second guided portion 39 of the drive shaft 23. According to the embodiment shown on the figures, the guide elements comprise two first guide bearings 42 provided on the first fixed scroll 4 and arranged for guiding the first guided portion 38 of the drive shaft 23.

It should be noted that the guide bearings 42, 43 are located on a same side of the drive shaft 23 in relation to the first end portion 35.

The scroll compressor 1 further comprises at least one bearing 44 provided on the orbiting scroll arrangement 7 and arranged for cooperating with the eccentric driving portion 41 of the drive shaft 23. According to the embodiment shown on the figures, the scroll compressor 1 comprises two bearings 44 provided on the orbiting scroll arrangement 7 and arranged for cooperating with the eccentric driving portion 41 of the drive shaft 23.

The drive shaft 23 further comprises a first and a second lubrication channels 45, 46 extending over a part of the length of the drive shaft 23 and arranged to be supplied with oil from the oil sump defined by the closed container 2, by an oil pump 47 driven by the second end portion 36 of the drive shaft 23.

According to the embodiment shown on the figures, the first and second lubrication channels 45, 46 are substantially parallel to the center axis of the drive shaft 23 and off-centered from the center axis of the drive shaft 23. However, according to another embodiment of the invention, the first and second lubrication channels 45, 46 may be inclined relative to the center axis of the drive shaft 23.

According to the embodiment shown on the figures, the oil pump 47 is made of a pump element having a substantially cylindrical connecting portion connected to the second end portion 36 of the drive shaft 23 and an end portion having a curved shape and provided with an oil opening. However, according to another embodiment of the invention, the oil pump 47 may be made of the second end portion 36 of the drive shaft 23.

The drive shaft 23 also comprises at least one first lubrication hole 48 fluidly connected to the first lubrication channel 45 and opening into an outer wall of the first guided portion 38 of the drive shaft 23, at least one second lubrication hole 49 fluidly connected to the second lubrication channel 46 and opening into an outer wall of the second guided portion 39 of the drive shaft 23, and at least one third lubrication hole 51 fluidly connected to the first lubrication channel 45 and opening into an outer wall of the eccentric driving portion 41 of the drive shaft 23. Advantageously, each of the first, second and third lubrication holes extends substantially radially relative to the drive shaft 23.

According to the embodiment shown on the figures, the drive shaft 23 comprises two first lubrication holes 48, one second lubrication hole 49 and two third lubrication holes 51, each first lubrication hole 48 facing one guide bearing 42, and each third lubrication hole 51 facing one bearing 44. According to an embodiment not shown on the figures, the drive shaft 23 may comprise only one third lubrication hole 51 located between the bearings 44.

The drive shaft 23 may further comprise a vent hole 52 fluidly connected on the one hand to the first lubrication channel 45 and on the other hand to the central recess 37 of the first end portion 35 of the drive shaft 23. The vent hole 52 may for example extend substantially radially relative to the drive shaft 23.

The drive shaft 23 may further comprise a communicating channel 53 arranged to fluidly connect the first and second lubrication channels 45, 46. The communicating channel 53 ensures the degassing of the oil circulating in the second lubrication duct 46, and the flow of the refrigerant originating from the degassing into the first lubrication duct 45 towards the vent hole 52.

The scroll compressor 1 also comprises a first Oldham coupling 54 which is slidably mounted with respect to the first fixed scroll 4 along a first displacement direction D1, and a second Oldham coupling 55 which is slidably mounted with respect to the second fixed scroll 5 along a second displacement direction D2 which is substantially orthogonal to the first displacement direction D1. The first and second displacement directions D1, D2 are substantially perpendicular to the rotation axis of the drive shaft 23. The first and second Oldham couplings 54, 55 are configured to prevent rotation of the orbiting scroll arrangement 7 with respect to the first and second fixed scrolls 4, 5. Each of the first and second Oldham couplings 54, 55 undergoes a reciprocating motion respectively along the first and second displacement directions D1, D2.

The first Oldham coupling 54 includes an annular body 56 disposed between the base plates 8, 13 of the first fixed scroll 4 and the orbiting scroll arrangement 7, and around the spiral wraps 9, 14. The first Oldham coupling 54 further includes a pair of first guiding grooves 57 provided on a first side of the annular body 56, and a pair of second guiding grooves 58 provided on a second side of the annular body 56. The first guiding grooves 57 of the first Oldham coupling 54 slidably receive a pair of first engaging projections 59 provided on the base plate 8 of the first fixed scroll 4, the first guiding grooves 57 being offset and extending parallel to the first displacement direction D1. The second guiding grooves 58 of the first Oldham coupling 54 slidably receive a pair of second engaging projections 61 provided on the base plate 13 of the orbiting scroll arrangement 7, the second guiding grooves 58 being offset and extending parallel to the second displacement direction D2, i.e. perpendicularly to the first displacement direction D1.

The second Oldham coupling 55 includes an annular body 62 disposed between the base plates 11, 13 of the second fixed scroll 5 and the orbiting scroll arrangement 7. The annular body 62 of the second Oldham coupling 55 extends substantially parallel to the annular body 56 of the first Oldham coupling 54.

The second Oldham coupling 55 further includes a pair of first guiding grooves 63 provided on a first side of the annular body 62, and a pair of second guiding grooves 64 provided on a second side of the annular body 62. The first guiding grooves 63 of the second Oldham coupling 55 slidably receive a pair of first engaging projections 65 provided on the second fixed scroll 5, the first guiding grooves 63 being offset and extending parallel to the second displacement direction D2. The second guiding grooves 64 of the second Oldham coupling 55 slidably receive a pair of second engaging projections 66 provided on the base plate 13 of the orbiting scroll arrangement 7, the second guiding grooves 64 being offset and extending parallel to the first displacement direction D1, i.e. perpendicularly to the second displacement direction D2.

The scroll compressor 1 further includes a first counterweight 67 and a second counterweight 68 connected to the drive shaft 23, and arranged to balance the mass of the orbiting scroll arrangement 7. The first counterweight 67 is located above the first fixed scroll 4, and the second counterweight 68 is located below the second fixed scroll 5.

According to the embodiment shown on the figures, the first counterweight 67 and the drive shaft 23 are formed as a one-piece element, and the second counterweight 68 is distinct from the drive shaft 23 and is attached to the latter. For example, the first counterweight 67 may be formed by removing material from the drive shaft 23.

In operation, a first part of the refrigerant entering in the inner volume 6 through the refrigerant suction pipe 19 is compressed into the compression chambers 16 and escapes from the centre of the first fixed scroll 4 and of the orbiting scroll arrangement 7 through the discharge passages 21 leading to the proximal chamber 32. The compressed refrigerant entering in the proximal chamber 32 then flows upwardly towards the distal chamber 33 by passing through refrigerant flow passages delimited by the stator 27 and the intermediate casing 25 and through gaps delimited between the stator 27 and the rotor 26. Next, the compressed refrigerant travels through the refrigerant discharge apertures 34 leading to the annular outer volume 31, from which the compressed refrigerant is discharged by the discharge pipe 20.

Thus the compressed refrigerant coming out of the discharge passages 21 cools down the first winding head 29*a*, the compressed refrigerant passing through the refrigerant flow passages cools down the stator core 28, the refrigerant passing through the gaps cools down the stator core 28, the stator windings and the rotor 26, while the compressed refrigerant coming out of the refrigerant flow passages and of the gaps cools down the second winding head 29*b*. Such a cooling down of the driving motor 24 protects the stator 27 and the rotor 26 against damage and improves the efficiency of the scroll compressor 1.

In operation, a second part of the refrigerant entering in the inner volume 6 through the refrigerant suction pipe 19 is compressed into the compression chambers 17 and escapes from the centre of the second fixed scroll 5 and of the orbiting scroll arrangement 7 partially through the communicating hole 18 and the discharge passages 21, and partially through the discharge passages 22 leading to the high pressure discharge volume. Therefore, a first part of the refrigerant compressed in the compression chambers 17 is discharged by the refrigerant discharge pipe 20 without cooling down the driving motor 24, and a second part of the refrigerant compressed in the compression chambers 17 is discharged by the refrigerant discharge pipe 20 after having cooling down the driving motor.

It should be noted that the configuration of the discharge passages 21, 22 allow to balance the pressure in the oil sump on the one hand, and the pressure in the space in which emerges the refrigerant discharge pipe 20 on the other hand. Such a pressure balance avoids the "oil cleaning" of the several bearings by the refrigerant.

Of course, the invention is not restricted to the embodiments described above by way of non-limiting examples, but on the contrary it encompasses all embodiments thereof.

What is claimed is:

1. A scroll compressor including:

a closed container, a scroll compression unit including:

a first fixed scroll and a second fixed scroll defining an inner volume, the first fixed scroll comprising a first fixed base plate and a first fixed spiral wrap, the second fixed scroll comprising a second fixed base plate and a second fixed spiral wrap, an orbiting scroll arrangement disposed in the inner volume, the orbiting scroll arrangement including a first orbiting spiral wrap and a second orbiting spiral wrap, the first fixed spiral wrap and the first orbiting spiral wrap forming a plurality of first compression chambers, the second fixed spiral wrap and the second orbiting spiral wrap forming a plurality of second compression chambers, a drive shaft including a driving portion adapted for driving the orbiting scroll arrangement in an orbital movement, a driving motor arranged for driving in rotation the drive shaft about a rotation axis, the driving motor including a rotor coupled to the drive shaft and a stator, the first fixed base plate having a first face directed towards the driving motor and a second face opposite to the first face and directed towards the second fixed scroll, wherein the first fixed scroll includes at least one first discharge passage arranged to conduct, in use, the refrigerant compressed in the first compression chambers towards the driving motor, wherein the orbiting scroll arrangement includes at least one communicating hole arranged to fluidly connect a central first compression chamber and a central second compression chamber, wherein the at least one first discharge passage is inclined relative to the rotation axis, and wherein, in use, the refrigerant compressed in the second compression chambers comprises a first part and a second part, where the first part of refrigerant is discharged from the scroll compressor without cooling down the drive motor and the second part of the refrigerant is discharged from the scroll compressor after having cooled down the driving motor.

2. The scroll compressor according to claim 1, wherein the at least one first discharge passage emerges nearby the driving motor.

3. The scroll compressor according to claim 1, wherein the stator includes a first winding head directed towards the first fixed scroll and a second winding head opposite to the first winding head, the scroll compressor further including an intermediate casing surrounding the stator and in which the driving motor is at least partially mounted, the intermediate casing and the driving motor at least partially defining a proximal chamber containing the first winding head of the stator.

4. The scroll compressor according to claim 3, wherein the at least one first discharge passage emerges in the proximal chamber.

5. The scroll compressor according to claim 3, wherein the intermediate casing and the driving motor define a distal chamber containing the second winding head of the stator, the intermediate casing being provided with at least one refrigerant discharge aperture emerging in the distal chamber.

6. The scroll compressor according to claim 1, wherein the drive shaft extends across the orbiting scroll arrangement and further includes a first guided portion and second guided portion located on either side of the driving portion, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

7. The scroll compressor according to claim 6, wherein the drive shaft further includes a rotor support portion on which is mounted the rotor, the guide elements being located on a same side of the drive shaft in relation to the rotor support portion.

8. The scroll compressor according to claim 1, further including:

a first Oldham coupling provided between the orbiting scroll arrangement and the first fixed scroll, and configured to prevent rotation of the orbiting scroll arrangement with respect to the first fixed scroll, the first Oldham coupling being slidable with respect to the first fixed scroll along a first displacement direction (D1), a second Oldham coupling provided between the orbiting scroll arrangement and the second fixed scroll, and configured to prevent rotation of the orbiting scroll arrangement with respect to the second fixed scroll, the second Oldham coupling being slidable with respect to the second fixed scroll along a second displacement direction (D2) which is transverse with respect to the first displacement direction (D1).

9. The scroll compressor according to claim 1, wherein the second fixed scroll includes at least one second discharge passage arranged to conduct, in use, at least a part of the refrigerant compressed in the second compression chambers outside the inner volume.

10. The scroll compressor according to claim 1, wherein the closed container defines a high pressure discharge volume containing the driving motor.

11. The scroll compressor according to claim 1, further including a refrigerant suction element for supplying the inner volume with refrigerant to be compressed, the refrigerant suction element may for example be sealingly connected to the inner volume.

12. The scroll compressor according to claim 1, wherein the scroll compressor is a vertical scroll compressor and the drive shaft extends vertically.

13. The scroll compressor according to claim 12, wherein the driving motor is located above the scroll compression unit.

14. The scroll compressor according to claim 2, wherein the stator includes a first winding head directed towards the first fixed scroll and a second winding head opposite to the first winding head, the scroll compressor further including an intermediate casing surrounding the stator and in which the driving motor is at least partially mounted, the intermediate casing and the driving motor at least partially defining a proximal chamber containing the first winding head of the stator.

15. The scroll compressor according to claim 4, wherein the intermediate casing and the driving motor define a distal chamber containing the second winding head of the stator, the intermediate casing being provided with at least one refrigerant discharge aperture emerging in the distal chamber.

16. The scroll compressor according to claim 2, wherein the drive shaft extends across the orbiting scroll arrangement and further includes a first guided portion and second guided portion located on either side of the driving portion, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

17. The scroll compressor according to claim 3, wherein the drive shaft extends across the orbiting scroll arrangement and further includes a first guided portion and second guided portion located on either side of the driving portion, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

18. The scroll compressor according to claim 4, wherein the drive shaft extends across the orbiting scroll arrangement and further includes a first guided portion and second guided portion located on either side of the driving portion, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

19. The scroll compressor according to claim 5, wherein the drive shaft extends across the orbiting scroll arrangement and further includes a first guided portion and second guided portion located on either side of the driving portion, the scroll compressor further including guide elements for guiding in rotation the drive shaft, the guide elements comprising at least one first guide bearing and at least one second guide bearing located on either side of the orbiting scroll arrangement and arranged to respectively guide the first and second guided portions of the drive shaft.

20. The scroll compressor according to claim 2, further including:

a first Oldham coupling provided between the orbiting scroll arrangement and the first fixed scroll, and configured to prevent rotation of the orbiting scroll arrangement with respect to the first fixed scroll, the first Oldham coupling being slidable with respect to the first fixed scroll along a first displacement direction (D1), a second Oldham coupling provided between the orbiting scroll arrangement and the second fixed scroll, and configured to prevent rotation of the orbiting scroll arrangement with respect to the second fixed scroll, the second Oldham coupling being slidable with respect to the second fixed scroll along a second displacement direction (D2) which is transverse with respect to the first displacement direction (D1).

21. The scroll compressor according to claim 1, wherein the drive shaft extends through a drive shaft passage defined by the first fixed scroll, and wherein the drive shaft passage is parallel to the rotation axis.

22. The scroll compressor according to claim 1, wherein the at least one first discharge passage has an end portion nearby a first winding head of the stator.

23. The scroll compressor according to claim 9, wherein the at least one second discharge passage is inclined relative to the rotation axis.

* * * * *